US007914433B2

(12) United States Patent
Herda et al.

(10) Patent No.: US 7,914,433 B2
(45) Date of Patent: Mar. 29, 2011

(54) FOLDING ROLLER AND CORRESPONDING FOLDING DEVICE

(75) Inventors: Philippe Herda, Nogent sur Oise (FR); Jérôme Peres, Montataire (FR); Eric Pierda, Saint Leu d'Esserent (FR); Franck Chagnon, Saint Leu d'Esserent (FR); Thierry Vauchelle, Maignelay Montigny (FR); Thierry Melon, Breuil le Vert (FR); Mathieu Rossi, Briot (FR)

(73) Assignee: Goss International Montataire SA, Montataire (FR)

( * ) Notice: Subject to any disclaimer, the term of this patent is extended or adjusted under 35 U.S.C. 154(b) by 0 days.

(21) Appl. No.: 12/284,543

(22) Filed: Sep. 23, 2008

(65) Prior Publication Data

US 2009/0247381 A1 Oct. 1, 2009

(30) Foreign Application Priority Data

Sep. 24, 2007 (FR) ..... 07 57793

(51) Int. Cl.
*B31F 7/00* (2006.01)

(52) U.S. Cl. ..... 493/444; 493/405; 493/416

(58) Field of Classification Search ..... 493/444, 493/405, 416, 436, 442, 443, 445; *B65H 45/16*
See application file for complete search history.

(56) References Cited

U.S. PATENT DOCUMENTS

| | | | | |
|---|---|---|---|---|
| 1,693,147 | A * | 11/1928 | King | 270/45 |
| 3,545,371 | A * | 12/1970 | Reist | 100/176 |
| 3,572,687 | A * | 3/1971 | Lindley | 493/15 |
| 3,576,051 | A * | 4/1971 | Click et al. | 425/72.1 |
| 3,773,315 | A * | 11/1973 | Tsien | 493/443 |
| 4,375,971 | A * | 3/1983 | Moll | 493/442 |
| 4,549,728 | A * | 10/1985 | Odeau | 270/46 |
| 4,717,375 | A * | 1/1988 | Lundmark | 493/360 |
| 4,767,392 | A * | 8/1988 | Moll | 493/331 |
| 4,781,667 | A | 11/1988 | Kitai | |
| 5,007,891 | A * | 4/1991 | von Hein | 493/444 |
| 5,129,876 | A * | 7/1992 | Brabant et al. | 493/471 |
| 5,169,376 | A * | 12/1992 | Ries et al. | 493/445 |
| 5,738,620 | A * | 4/1998 | Ebner et al. | 493/445 |
| 6,551,228 | B1 * | 4/2003 | Richards | 493/417 |
| 6,592,506 | B1 * | 7/2003 | Lyga | 493/424 |
| 6,602,176 | B1 * | 8/2003 | Ganneval | 493/405 |
| 6,808,480 | B2 * | 10/2004 | Neubauer et al. | 493/458 |
| 6,932,755 | B2 * | 8/2005 | Teshima et al. | 493/434 |
| 6,939,283 | B2 * | 9/2005 | Sparano et al. | 493/424 |
| 7,326,166 | B2 * | 2/2008 | Sytema | 493/421 |

FOREIGN PATENT DOCUMENTS

| | | |
|---|---|---|
| EP | 0 366 611 A2 | 5/1990 |
| EP | 0 855 356 B1 | 7/1999 |

* cited by examiner

*Primary Examiner* — Paul R Durand
(74) *Attorney, Agent, or Firm* — Davidson, Davidson & Kappel, LLC

(57) ABSTRACT

A folding roller is provided for a device for folding a flat product to be folded which extends along a center axis and includes a first axial portion and a second axial portion, the first axial portion having a first surface for folding the product to be folded. The second axial portion includes a main relief which is radially recessed relative to the first folding surface.

13 Claims, 5 Drawing Sheets

FOLDING ROLLER AND CORRESPONDING FOLDING DEVICE

This claims the benefit of FR 07 57793 filed on Sep. 24, 2007 and hereby incorporated by reference herein.

The present invention relates to a folding roller for a device for folding a flat product to be folded, the roller extending along a center axis.

BACKGROUND

From the prior art, folding rollers are known which comprise front and rear axial portions. During use, the rear axial portion extends in the region of a rear portion of a signature to be folded, whilst the front axial portion extends in the region of a front edge of a signature to be folded.

The rear axial portion comprises a recess which is capable of releasing the upper portion of the signature to be folded in order to prevent occurrences of creasing of the downstream portion of the folded booklet.

Known folding rollers are capable of gripping the central portion of the booklet in the region of the front edge thereof in order to fold the booklet.

SUMMARY OF THE INVENTION

However, it has been found that known folding rollers lead to occurrences of creasing in the region of the front edge at the location of the fold.

An object of the invention is to improve the quality of folding, in particular at high folding speeds.

To this end, the present invention provides a folding roller of the type indicated above, characterized in that the second axial portion comprises a main relief which is radially recessed relative to the first folding surface, the second axial portion including a second surface for folding the product to be folded and the main relief being radially recessed relative to the second folding surface.

According to specific embodiments, the folding roller may include one or more of the following features:

the first folding surface and the second folding surface are radially aligned;

the first axial portion includes an auxiliary relief which is radially recessed relative to the first folding surface, the auxiliary relief and the main relief extending over different angular ranges around the center axis;

the auxiliary relief extends over an angular range of between 120° and 160°, and preferably between 140° and 150°, around the center axis;

the main relief extends over an angular range greater than 270°, in particular greater than one of the ranges 300°, 310° and 320°, and this angular range is a maximum of 325°, around the center axis;

the first folding surface and the auxiliary relief form a first connection edge; the second folding surface and the main relief form a second connection edge and the first connection edge and the second connection edge are circumferentially aligned;

the roller includes a third axial portion which has a third folding surface which extends all the way around the center axis and which is centered on the center axis and which is radially aligned with the first folding surface, the third axial portion extending axially between the first axial portion and the second axial portion;

the roller includes a fourth axial portion which defines a cylindrical surface which extends all the way around and which is centered on the center axis, and which is radially aligned with the first folding surface, and the second axial portion is arranged axially between the first axial portion and the fourth axial portion and;

the roller includes at least one groove which extends all the way around and which extends axially between the first axial portion and the second axial portion.

The invention also provides a folding device including:

a folding plate;

two folding rollers which together define a folding gap, at least one of the folding rollers being a folding roller as defined above.

According to specific embodiments, the folding device may include one or more of the following features:

the folding device defines a conveying direction for products to be folded, and the second axial portion is arranged downstream of the first axial portion in the conveying direction;

the two folding rollers are capable of being driven in such a manner that their second folding surface is capable of overlapping a central portion of a product to be folded at the location of a front edge of this product, and the main relief is capable of overlapping a lateral portion of the front edge of the product to be folded when the product to be folded is gripped by the two rollers;

the folding device includes a stop which is capable of stopping the product to be folded, and the stop is axially aligned with the main relief.

BRIEF DESCRIPTION OF THE DRAWINGS

The invention will be better understood from a reading of the following description, given purely by way of example and with reference to the appended drawings, in which.

DETAILED DESCRIPTION

Figure 1:
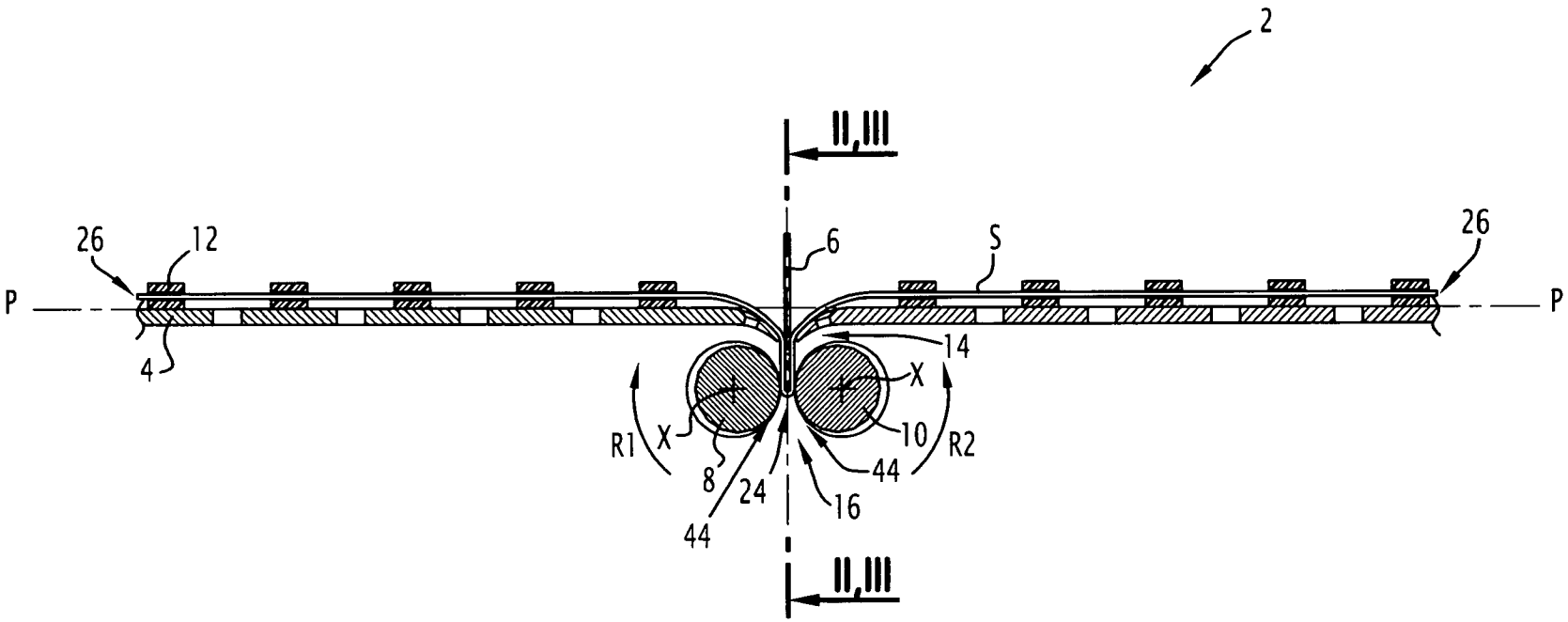
FIG. 1 is a sectioned view of a folding device according to the invention.
Figure 2:
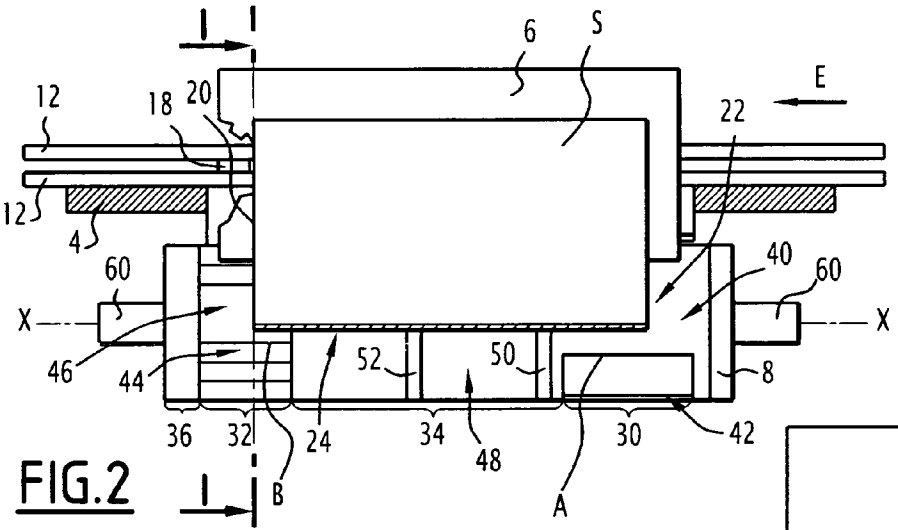
FIG. 2 is a partially sectioned side view of the folding device according to the invention, when viewed along the section II of FIG. 1.
Figure 3:
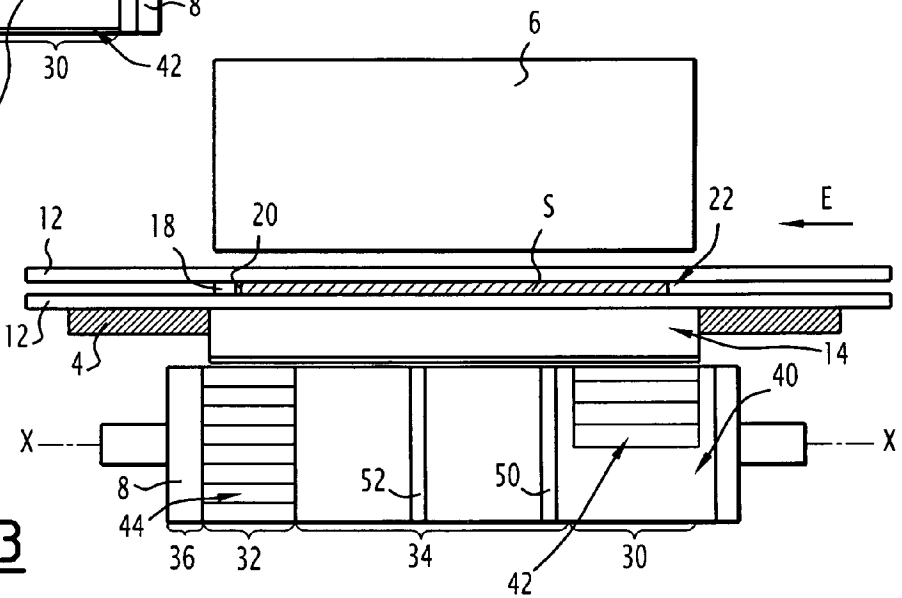
FIG. 3 is a view corresponding to the view of FIG. 2 of the folding device before the folding operation.
Figure 4:
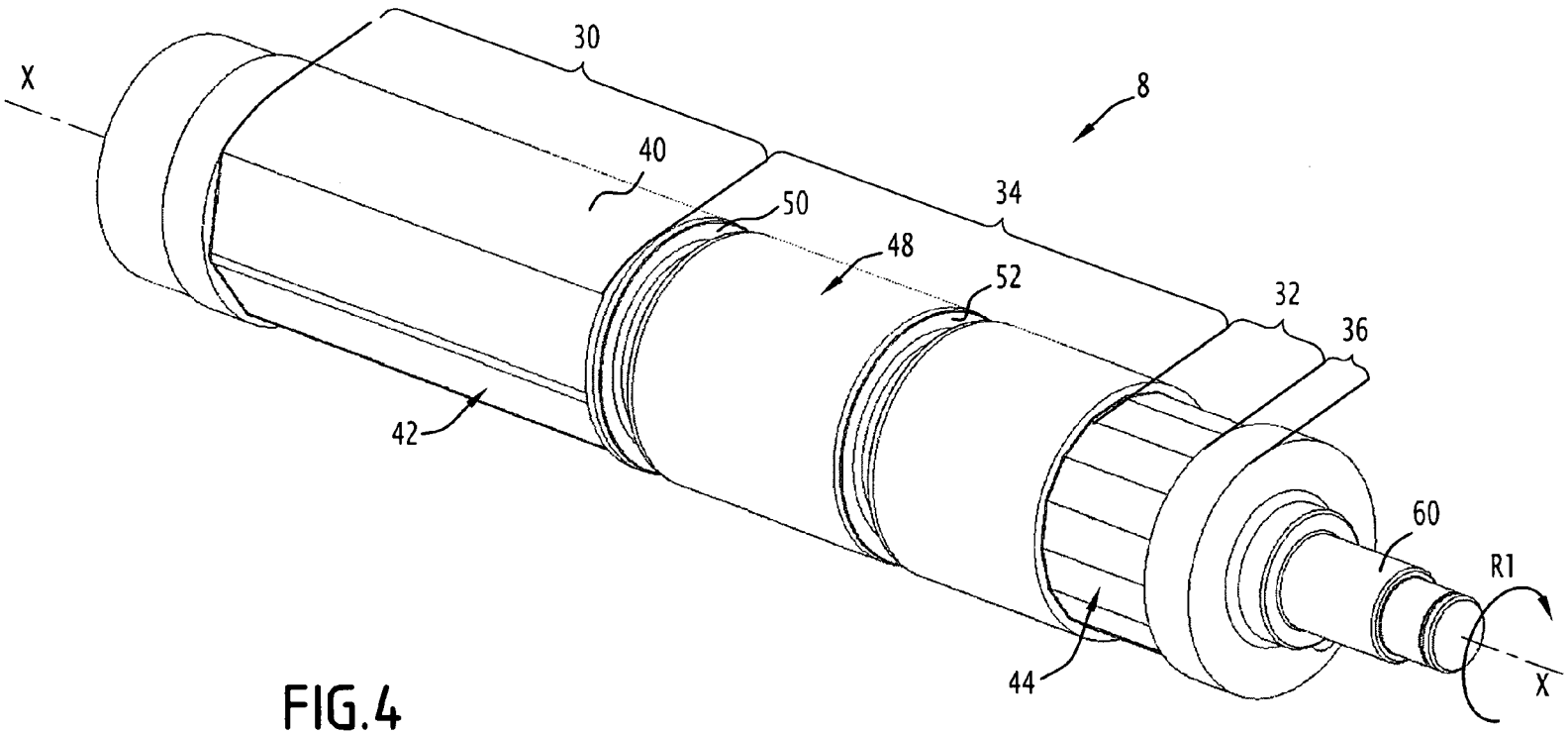
FIGS. 4 and 5 are perspective views of a folding roller according to the invention.

FIG. 1 illustrates a folding device according to the invention, generally designated 2.

The folding device 2 includes a chopper folding device of a rotary press, in particular an offset press.

The folding device 2 includes a folding table 4, a folding plate 6, two folding rollers 8 and 10 and conveying belts 12.

The folding device 2 is capable of folding a signature S which is conveyed by the conveying belts 12 on the folding table.

The folding table 4 extends along a table plane P-P and defines a folding aperture 14.

The folding plate 6 is arranged above the folding table 4 and is capable of pushing the central portion 24 of a signature S through the folding aperture 14.

The folding rollers 8, 10 each extend along a center axis X-X and together delimit a folding gap 16. The folding roller 8 is driven in a first rotation direction R1 and the folding roller 10 is driven in a second rotation direction R2 opposed to the first rotation direction R1.

Furthermore, the folding device 2 includes a stop 18 which is capable of stopping the signature S before it is folded.

The conveying belts 12 are driven in a driving direction E or conveying direction which extends from an inlet of the folding device 2 towards the stop 18.

Each signature S delimits a front edge 20 which is directed downstream of the driving direction E and a rear edge 22 which is directed upstream of the driving direction E, each signature S also including a central portion 24 which is folded by the plate 6 and the folding rollers 8 and 10. Each signature also includes two lateral edges 26 which extend parallel with the driving direction E.

The signature S includes a single flat sheet. In a variant, the signature S may include at least one folded sheet whose fold forms the front edge 20.

The features of the folding roller 8 will be described below, the folding roller 10 being symmetrical (see FIG. 6) relative to a plate plane along which the folding plate 6 extends.

The folding roller 8 includes a first axial portion 30, a second axial portion 32, a third axial portion 34 and a fourth axial portion 36.

The first axial portion 30 includes a first surface 40 for folding the signature S to be folded. This folding surface 40 is a partially cylindrical surface having a circular cross-section about the center axis X-X.

The first axial portion 30 further includes an auxiliary relief 42 which is radially recessed relative to the first folding surface 40. This auxiliary relief 42 includes planar faces. The first axial portion 30 extends during the folding operation in the region of the rear edge 22 of the signature S. The connection between the first folding surface 40 and the auxiliary relief 42 forms a first connection edge A which is located at the downstream end of the auxiliary relief 42, when viewed in the first rotation direction R1.

The auxiliary recess 42 extends around the center axis X-X over an angular range of between 120° and 160°, and preferably between 140 and 150°.

The roller 8 is driven in such a manner that the first folding surface 40 grips the central portion 24 when the folding plate 6 pushes the signature S into the folding gap 16. That is to say, the two first folding surfaces 40 of the folding rollers 8, 10 grip the central portion 24 of the signature S.

The second axial portion 32 extends axially so as to overlap the front edge 20 during the folding operation when the folding device is in operation. To this end, the second axial portion 32 and therefore the auxiliary relief 42 axially overlaps the stop 18.

The second axial portion 32 includes a main relief 44 which is radially recessed relative to the folding surface 40 of the first axial portion 30.

Figure 5:
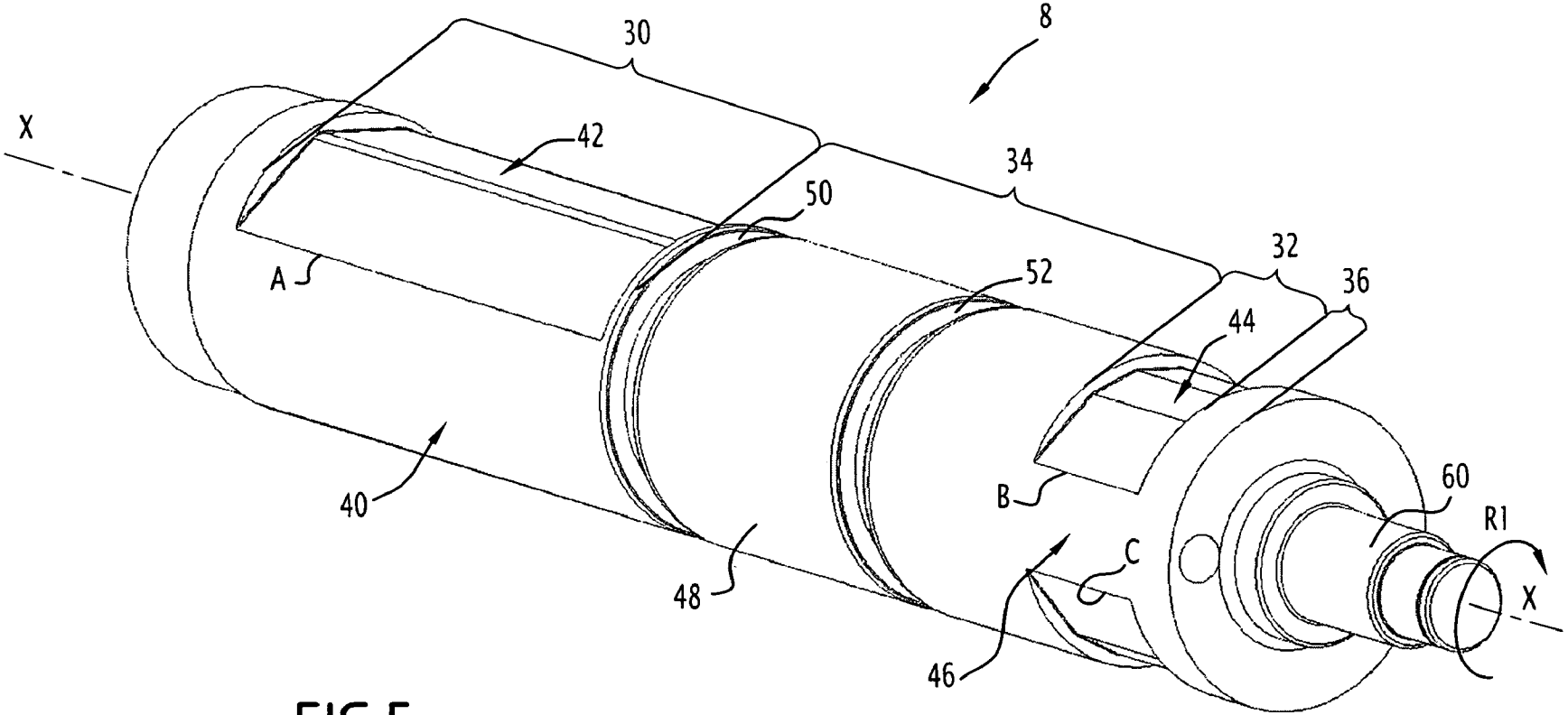

As can be seen in FIG. 5, the second axial portion 32 further includes a second folding surface 46 which is a partial cylindrical surface having a circular cross-section about the axis X-X. The second folding surface 46 is radially aligned with the first folding surface 40.

The main relief 44 extends around the center axis X-X over an angular range of preferably between 320 and 325°. Generally, it may be greater than 270°, in particular greater than one of the ranges 300°, 310° and 320°, and this angular range is a maximum of 325°. The connection between the second folding surface 46 and the main relief 44 forms a second connection edge B located at the downstream end of the main relief 44, when viewed in the first rotation direction R1. The first connection edge A and the second connection edge B are circumferentially aligned.

The connection between the second folding surface 46 and the main relief 44 forms a third connection edge C which is located at the upstream end of the main relief 44 when viewed in the first rotation direction R1. This third connection edge C is circumferentially overlapped by the folding surface 40.

The angular range of the auxiliary relief 42 completely overlaps the angular range of the main relief 44 in the circumferential direction around the center axis X-X. That is to say, the folding surfaces 40 and 46 are axially aligned. The main relief 44 and the auxiliary relief 42 thus extend over different angular ranges around the center axis X-X.

The third axial portion 34 extends axially between the first axial portion 30 and the second axial portion 32. The third axial portion 34 is provided with a third folding surface 48 which extends all the way around the center axis X-X. The third folding surface 48 therefore has a cylindrical shape having a complete circular cross-section around the center axis. The third folding surface 48 is radially aligned with the first folding surface 40. This third axial portion is therefore capable of gripping the signature S over the entire width between the central portion 24 and the lateral edges 26 thereof.

The third axial portion 34 is further provided with two grooves 50, 52 which extend all the way around.

Figure 6:
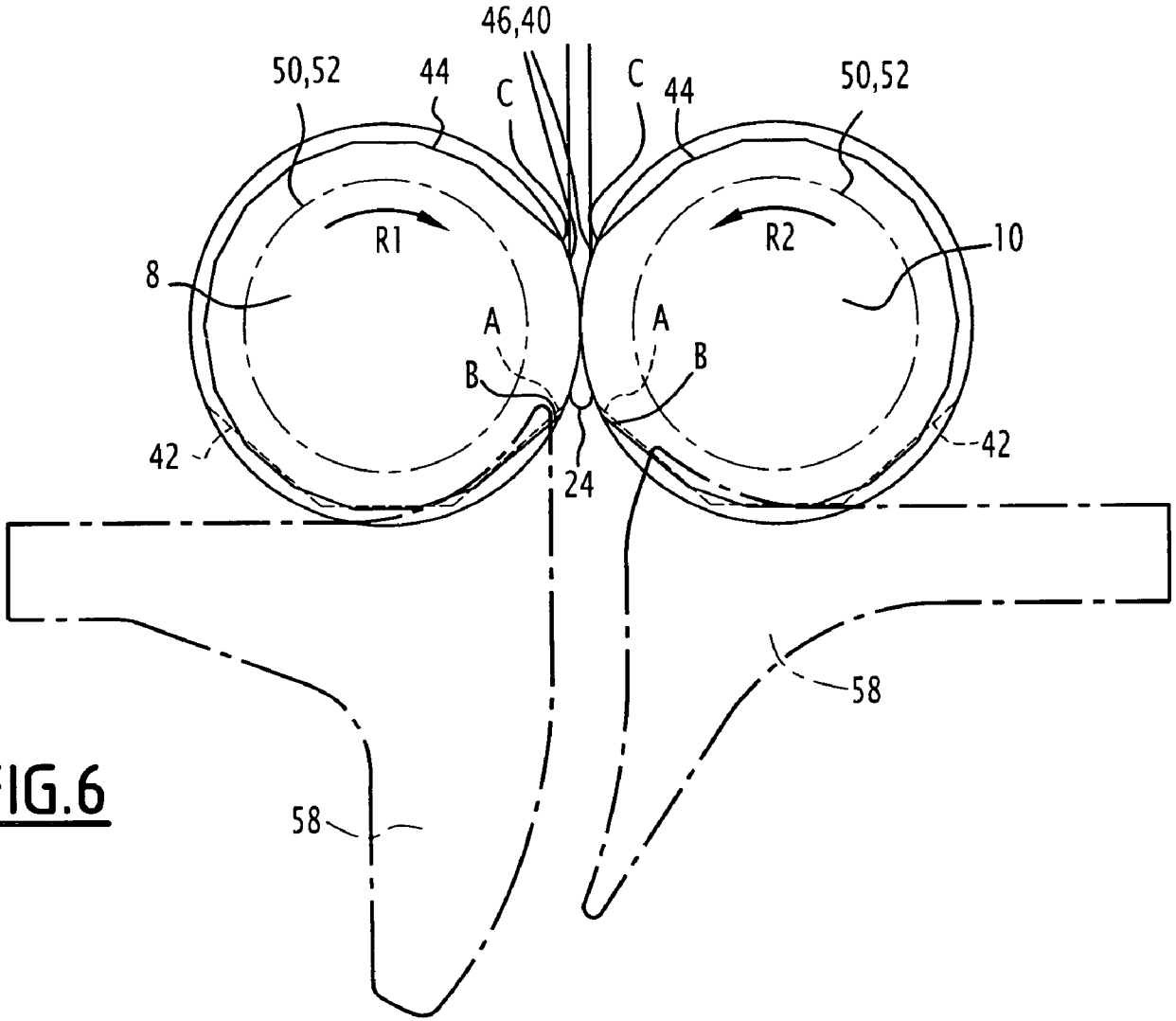
FIG. 6 is a schematic axial view of the folding rollers and strippers.

As illustrated in FIG. 6, the folding device 2 also includes strippers 58 which engage in the grooves 50, 52 and which are capable of guiding the folded signature and removing it from the folding rollers 8, 10.

The fourth axial portion 36 includes a cylindrical surface which has a circular cross-section which is centered on the axis X-X. The second axial portion 32 is arranged axially between the fourth axial portion 36 and the first axial portion 30 or the third axial portion 34.

The folding roller 8 further includes two pins 60 which are arranged at each side of the roller.

The folding device 2 operates in the following manner.

The signatures S are transported by the conveying belts 12 as far as the stop 18.

When the signature S reaches the stop position thereof, the folding plate 6 pushes the central portion 24 through the folding aperture 14 and the central portion 24 is gripped by the first folding surface 40 and by the third folding surface 48. Furthermore, the portion of the central portion 24 which overlaps the second axial portion 32, and the portion of the front edge 20 adjacent to the central portion are first gripped by the second folding surface 46.

Then, the signature S is conveyed through the folding gap 16 via the first, the second and the third folding surfaces until the main relief 44 releases the portion of the front edge 20 of the signature at a location remote from the fold formed in the central portion 24. At the same time, the first folding surface 40 and the third folding surface 48 continue driving the signature through the gap 16.

When the folding rollers 8, 10 continue to rotate, the lateral edges 26 of the signature S are released in the region of the first axial portion 30 via the auxiliary relief 42. This prevents untimely folding of the lateral edges in the region of the rear edge 22.

Taking into account that the folding rollers according to the invention release a large portion of the front edge 20, they allow creases to be prevented in the region of the front edge 20 at the location of the central portion 24, even at high folding speeds.

What is claimed is:

1. A folding roller for a device for folding a flat product to be folded, the roller extending along a center axis and comprising:

a first axial portion on a first axial half; and a second axial portion on a second axial half, the first and second axial halves being divided by a center plane, the first axial portion having a first surface for folding the product to be folded, the second axial portion including a main relief radially recessed relative to the first folding surface, the second axial portion including a second surface for folding the product to be folded, the main relief being radially recessed relative to the second folding surface, the main relief extending over an angular range greater than 270°, the angular range having a maximum of 325°, around the center axis, the first axial half and the second axial half being asymmetrical with respect to one another about the center plane.

2. The folding roller according to claim 1 wherein the first folding surface and the second folding surface are radially aligned.

3. The folding roller according to claim 1 wherein the first axial portion includes an auxiliary relief radially recessed relative to the first folding surface, the auxiliary relief and the main relief extending over different angular ranges around the center axis.

4. The folding roller according to claim 1 wherein the auxiliary relief extends over an angular range between 120° and 160°, and preferably between 140° and 150°, around the center axis.

5. The folding roller according to claim 1 wherein the main relief extends over the angular range at an angle greater than 300°.

6. The folding roller according to claim 1 wherein the first folding surface and the auxiliary relief form a first connection edge, the second folding surface and the main relief form a second connection edge and the first connection edge and the second connection edge are circumferentially aligned.

7. The folding roller according to claim 1 wherein the roller includes at least one groove extending all the way around and extending axially between the first axial portion and the second axial portion.

8. A folding roller for a device for folding a flat product to be folded, the roller extending along a center axis and comprising:

a first axial portion;

a second axial portion, the first axial portion having a first surface for folding the product to be folded, the second axial portion including a main relief radially recessed relative to the first folding surface, the second axial portion including a second surface for folding the product to be folded, the main relief being radially recessed relative to the second folding surface, the main relief extending over an angular range greater than 270° , the angular range having a maximum of 325°, around the center axis; and a third axial portion having a third folding surface extending all the way around the center axis and centered on the center axis, the third folding surface being radially aligned with the first folding surface such that third folding surface is the same radial distance from the center axis as the first folding surface, the third axial portion extending axially between the first axial portion and the second axial portion.

9. The folding roller according to claim 8 further comprising a fourth axial portion defining a cylindrical surface extending all the way around and centered on the center axis, the cylindrical surface of the fourth axial portion being radially aligned with the first folding surface such that cylindrical surface of the fourth axial portion is the same radial distance from the center axis as the first folding surface, the second axial portion being arranged axially between the first axial portion and the fourth axial portion.

10. A folding device comprising:

a folding plate;

two folding rollers which together define a folding gap, the folding plate pushing a product to be folded into the folding gap, at least one of the folding rollers extending along a center axis and including:

a first axial portion; and a second axial portion, the first axial portion having a first surface for folding the product to be folded, the second axial portion including a main relief radially recessed relative to the first folding surface, the second axial portion including a second surface for folding the product to be folded, the main relief being radially recessed relative to the second folding surface, the main relief extending over an angular range greater than 270°, the angular range having a maximum of 325°, around the center axis; and a stop capable of stopping the product to be folded, the stop being axially aligned with the main relief such that the stop stops a front edge of the product to be folded and sets a position of the front edge so the front edge is axially aligned with the main relief as the folding plate pushes the product to be folded into the folding gap.

11. The folding device according to claim 10 wherein the folding device defines a conveying direction for products to be folded, and the second axial portion is arranged downstream of the first axial portion in the conveying direction.

12. The folding device according to claim 10 wherein the two folding rollers are capable of being driven so the second folding surface is capable of overlapping a central portion of a product to be folded at a location of a front edge of the product, the main relief being capable of overlapping a lateral portion of the front edge of the product to be folded when the product to be folded is gripped by the two rollers.

13. A folding device for folding a product having a front edge, the folding device comprising:

a folding plate; and two folding rollers which together define a folding gap, the folding plate pushing the product into the folding gap, at least one of the folding rollers extending along a center axis and including:

a first axial portion having a first folding surface for folding the product; and a second axial portion having a second folding surface for folding the product and a main relief radially recessed relative to the first folding surface and second folding surface, the main relief extending over an angular range greater than 270° around the center axis, the folding plate and the two folding rollers being arranged and configured such that the folding plate pushes the product into the folding gap so the second folding surface receives a first portion of the front edge of the product and the main relief receives a second portion of the front edge of the product.

* * * * *